US006769180B2

(12) United States Patent
Coffin

(10) Patent No.: US 6,769,180 B2
(45) Date of Patent: Aug. 3, 2004

(54) SHAVING IMPLEMENT HAVING STATIC AND DYNAMIC BLADES

(75) Inventor: David C. Coffin, Milford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 56 days.

(21) Appl. No.: 10/187,506

(22) Filed: Jul. 1, 2002

(65) Prior Publication Data

US 2003/0046817 A1 Mar. 13, 2003

Related U.S. Application Data

(60) Provisional application No. 60/302,478, filed on Jul. 2, 2001.

(51) Int. Cl.[7] ..... B26B 21/16
(52) U.S. Cl. ..... 30/50; 30/47
(58) Field of Search ..... 30/34.1, 34.05, 30/50, 47, 48, 51, 62, 63

(56) References Cited

U.S. PATENT DOCUMENTS

| | | | | |
|---|---|---|---|---|
| 3,890,704 A | | 6/1975 | Ferraro | |
| 4,026,016 A | | 5/1977 | Nissen | 30/47 |
| 4,272,885 A | | 6/1981 | Ferraro | |
| 4,403,412 A | | 9/1983 | Trotta | |
| 4,443,940 A | * | 4/1984 | Francis et al. | 30/50 |
| 5,056,222 A | | 10/1991 | Miller et al. | |
| 5,251,376 A | * | 10/1993 | Althaus et al. | 30/50 |
| 5,253,420 A | | 10/1993 | Althaus et al. | 30/50 |
| 5,341,571 A | | 8/1994 | Prochaska | |
| 5,359,774 A | | 11/1994 | Althaus | |
| 5,461,781 A | | 10/1995 | Pirc | 30/41 |
| 5,813,119 A | | 9/1998 | Ferraro | |
| D424,744 S | | 5/2000 | Coffin | |
| 6,145,201 A | * | 11/2000 | Andrews | 30/50 |
| 6,167,625 B1 | | 1/2001 | King | |

FOREIGN PATENT DOCUMENTS

| | | | |
|---|---|---|---|
| WO | WO 9630176 | 10/1996 | B26B/21/40 |

* cited by examiner

*Primary Examiner*—Hwei-Siu Payer
(74) *Attorney, Agent, or Firm*—McCormick, Paulding & Huber LLP

(57) ABSTRACT

In a shaving implement having static and dynamic blades a shaving head includes an approximately rigid guard and a cap spaced away from and approximately parallel to the guard. The guard and cap each extending longitudinally of the shaving head. A static blade is secured to the shaving head and defines a cutting edge located between and approximately parallel to the guard and cap. The shaving head defines a cavity adjacent to the static blade and the cartridge adapted to be slidably received in the cavity includes at least one dynamic blade mounted therein. The dynamic blade is movable relative to the static blade during a shaving operation.

17 Claims, 4 Drawing Sheets

SHAVING IMPLEMENT HAVING STATIC AND DYNAMIC BLADES

FIELD OF THE PRESENT INVENTION

The present application is a U.S. non-provisional application. This application claims the benefit of 60/302,478 filed Jul. 2, 2001.

The present invention is generally directed to shaving implements, and is more particularly directed to a shaving head comprising part of a razor or disposable razor cartridge. The shaving head includes static blades as well as movable or dynamic blades.

BACKGROUND OF THE PRESENT INVENTION

The present invention is directed to shaving implements for use in the removal of hair from skin. Accordingly, the term "implement" as used herein should be broadly construed to include one-piece razors and disposable razor cartridges adapted to releasably engage a razor handle.

Historically, developers of razors used for shaving have striven to achieve two seemingly divergent objectives. The first is to provide the user with an implement that will produce the closest shave possible. The second objective is to make the use of the shaving implement as comfortable as possible. The difficulty occurs due to the fact that to achieve a close shave the exposure to the skin of the razor blade, or blades, incorporated into the implement should be maximized. This increases the potential for nicks and cuts in the user's skin. Where multiple razor blades are incorporated into the shaving implement there is the tendency for the skin to bulge between the blades further increasing the possibility for injury. Therefore to increase the comfort of a shaving operation, the exposure of the razor blades to the user's skin should be minimized. Attempts to address this dichotomy of objectives have been made in the prior art.

For example, some multi-bladed shaving implements incorporate spacers between the blades, which extend past the shaving plane, thereby reducing the amount of blade exposure to the user's skin. Alternatively, wires are sometimes wrapped over the blades. While increasing comfort, the closeness of the shave can be adversely affected by the use of spacers or wire.

One method for increasing the closeness of a shave when razors incorporating the above-described spacers have been used is to increase the number of blades in the shaving implement. However, razor blades are typically mounted in shaving implements in fixed relationship relative to one another and tend not to closely follow the contours of the user's skin. Where multiple razor blades are employed, even pivoting shaving heads tend not to provide sufficient contour following capabilities. Accordingly, while increasing the number of blades improves the closeness of a shave, there is still a need for at least some of the blades to have the ability to follow the contour of a user's skin.

Based on the foregoing, it is the general object of the present invention to provide shaving implements that overcome the drawbacks and problems associated with prior art showing implements.

SUMMARY OF THE PRESENT INVENTION

The present invention is directed in one aspect to a shaving implement having a shaving head defined in part by an approximately rigid guard and a cap. The approximately rigid guard and the cap being spaced apart from, and approximately parallel to one another. A static blade is secured to the shaving head between the guard and cap and defines a cutting edge approximately parallel thereto. The cutting edge of the static blade is adjacent to a plane, referred to by those skilled in the pertinent art to which the invention pertains as a "shaving plane." The shaving plane is oriented along a line tangent to the guard and cap and extends longitudinally thereof. A cavity is defined by the shaving head adjacent to the static blade, and is adapted to slidably receive a cartridge having at least one dynamic blade mounted therein. The dynamic blade also includes a cutting edge that is approximately parallel to the cutting edge of the static blade when the cartridge is positioned within the cavity. Biasing means are provided for urging the cartridge toward a neutral position in response to forces exerted against the dynamic blade. Once in the neutral position the cutting edge of the dynamic blade extends past the shaving plane. Accordingly, during a shaving operation, the cartridge is slidingly movable within the cavity in response to forces exerted against the dynamic blade, with the biasing means providing a restoring force that moves the cartridge to the neutral position when the forces are removed from the dynamic blade.

In the preferred embodiment of the present invention, the biasing means is in the form of a resilient strip mounted onto posts protruding from the shaving head approximately opposite the cutting edge of the static blade. Preferably, the resilient strip is metallic and made from spring steel, however, the present invention is not limited in this regard as other materials such as resilient polymers or rubbers may be employed. The resilient strip is in communication with the above-described cartridge. During a shaving operation, force exerted by a user from pressing the dynamic blade against skin causes the cartridge to move relative to the shaving head. The resilient strip acts to at least partially counteract this force thereby urging the cartridge toward the neutral position, allowing the dynamic blade to follow the contours of the user's skin.

Preferably, the shaving implement of the present invention includes two static blades and two dynamic blades. The two static blades define a gap therebetween with a plurality of rails positioned in the gap and spaced apart from one another. The rails each extend along facing surfaces of the static blades approximately perpendicular to the cutting edges. In addition, a second set of rails is positioned on the static blade proximate to the cavity. Similarly, these rails are spaced apart from one another and extend along the blade approximately perpendicular to the cutting edge thereof. Each rail in the second set of rails defines a surface that extends into the cavity that is adapted to slidably support the cartridge.

It is desirable that all of the rails define a tip portion extending past the shaving plane for engaging the skin of a user during a shaving operation. These tip portions are generally rounded and serve to limit the exposure of skin to the blades as the shaving head is drawn across the skin during a shaving operation.

DETAILED DESCRIPTION OF THE PREFERRED EMBODIMENTS

Figure 1:
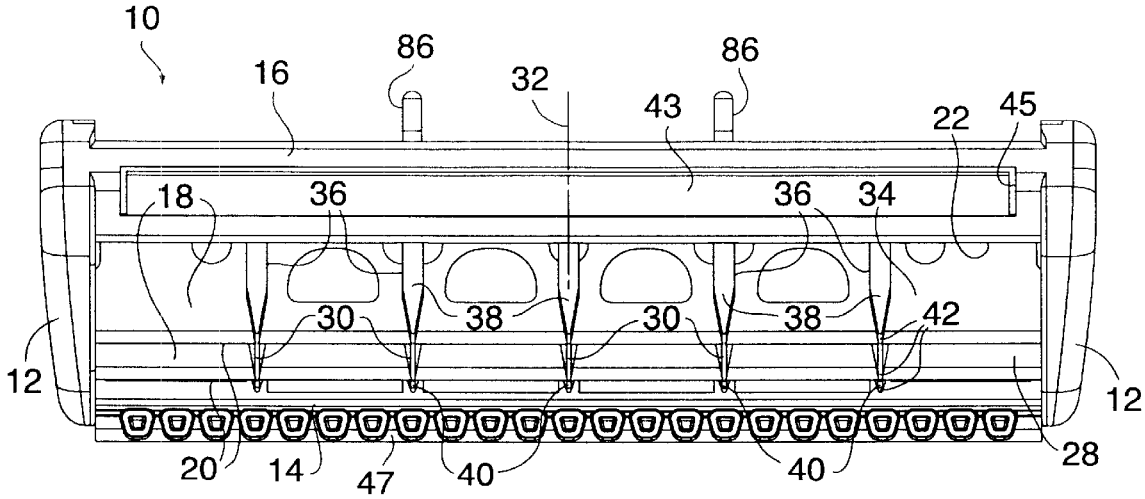
FIG. 1 is a plan view of the shaving head of the present invention showing a pair of static blades mounted thereto and a cavity extending at least part way through the shaving head and adapted to slidably receive a cartridge having at least one dynamic blade mounted thereon.
Figure 2:
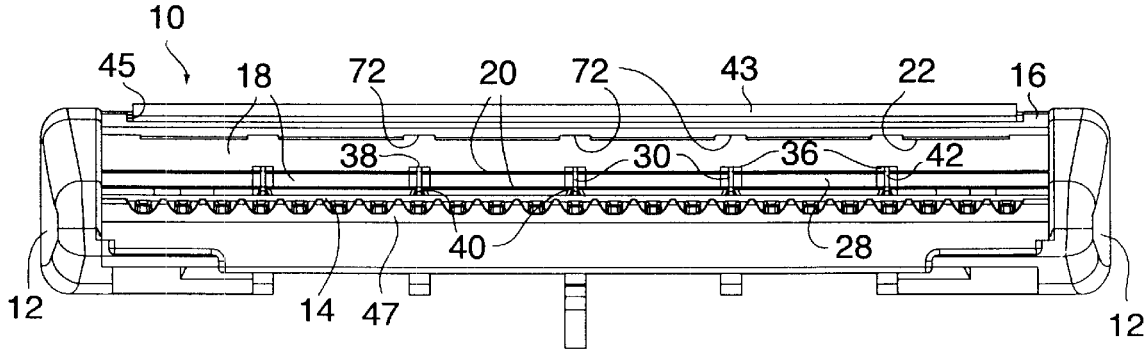
FIG. 2 is a front elevational view of the shaving head of FIG. 1.
Figure 3:
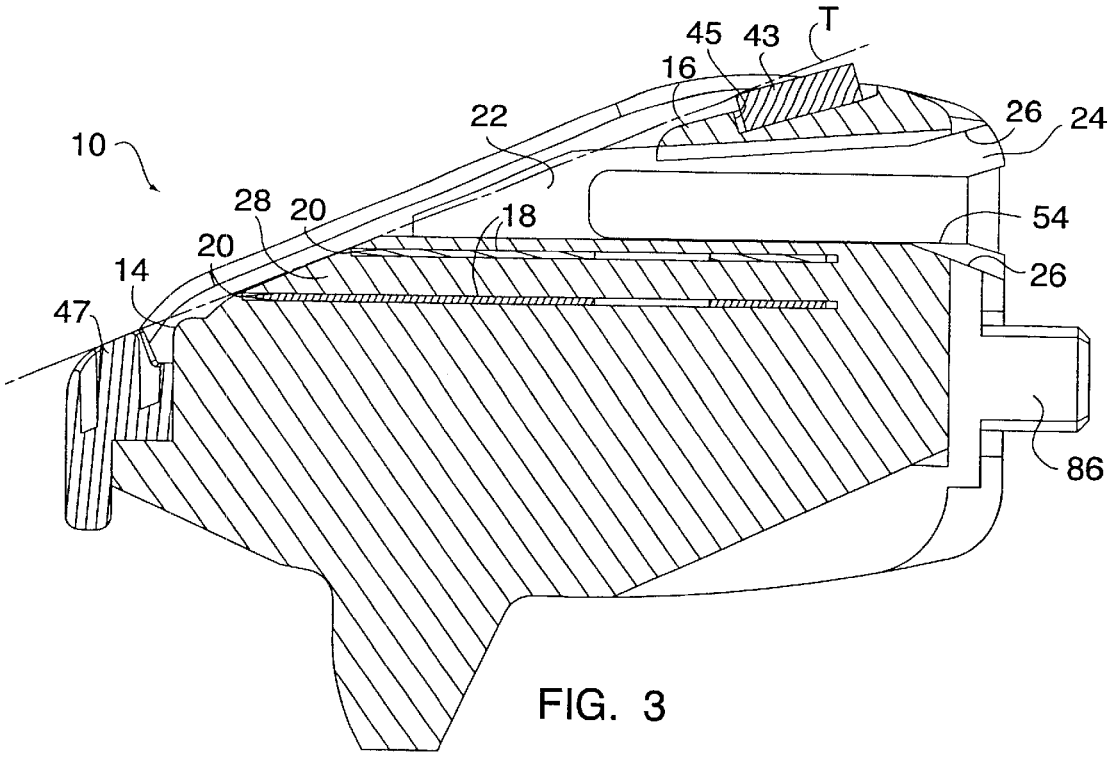
FIG. 3 is an enlarged cross-sectional view of the shaving head of FIG. 1.

As shown in FIGS. 1–3, the shaving implement of the present invention includes a shaving head generally referred to by the reference number 10 that includes a pair of end walls 12. An approximately rigid guard 14 and a cap 16 are interposed between and attached to the end walls 12. The approximately rigid guard 14 and the cap 16 are spaced apart relative to one another and a pair of static blades 18 is secured to the shaving head 10 between the guard and the cap. Each of the static blades 18 has a cuffing edge 20 extending longitudinally of the approximately rigid guard 14 and the cap 16. The cutting edges 20 of the static blades 18 are positioned such as to lie along a plane defined by a line, labeled in FIG. 3 by the letter "T," which is parallel to a tangent to the guard and cap, 14 and 16 respectively, and extending longitudinally thereof. While a pair of static blades 18 has been shown and described, the present invention is not limited in this regard as one, or more than two static blades can be mounted to the shaving head 10 without departing from the broader aspects of the present invention.

As best seen in FIG. 3, the shaving head 10 defines a cavity 22 extending from an opening 24 located approximately opposite the cutting edges 20 of the static blades 18. The cavity 22 extends at least partway through the shaving head 10 with the opening 24 having tapered walls 26, the purpose for which will be explained in detail hereinbelow.

Referring to FIGS. 1 and 2, the pair of static blades 18 are spaced apart from one another and define a gap 28 therebetween. A plurality of first rails 30 are positioned in the gap 28, spaced apart relative to one another and engaging each of the static blades 18. The first rails 30 each define a longitudinal axis 32 that is approximately perpendicular to the cuffing edges 20 of the static blades 18. In the illustrated embodiment, one of the pair of static blades 18 includes a surface 34 that partially extends into the cavity 22. A plurality of second rails 36 are positioned in spaced apart relation relative to one another along the surface 34 and also partially extend into the cavity 22. Each second rail 36 also defines a longitudinal axis 32 that is approximately perpendicular to the cuffing edges 20 of the static blades 18. The second rails 36 each define a support surface 38 that extends into the cavity 22 from the surface 34.

Still referring to FIGS. 1 and 2, a third set of rails 40, similar to the first and second sets of rails, 30 and 36 respectively, are positioned between the guard 14 and the static blade 18 that is adjacent to the guard 14. Each of the first, second, and third sets of rails, 30, 36, and 40 respectively, includes a tip portion 42 that extends past the shaving plane and is preferably rounded for engaging a user's skin during a shaving operation. While the first, second and third sets of rails, 30, 36, and 40 are shown in the illustrated embodiment as being aligned and equally spaced relative to one another, the present invention is not limited in this regard. The first second and third sets of rails, 30, 36, and 40 respectively can be staggered and/or unequally spaced relative to one another without departing from the broader aspects of the present invention.

As best seen in FIG. 3, the shaving head 10 can incorporate a comfort strip 43 positioned in a recess 45 defined by the cap 16. The comfort strip 43 can be formed from a permeable material impregnated with a shaving aid, such as, but not limited to lotion. In addition, a resilient guard 47 can be mounted to the shaving head 10 adjacent to the approximately rigid guard 14.

Figure 4:
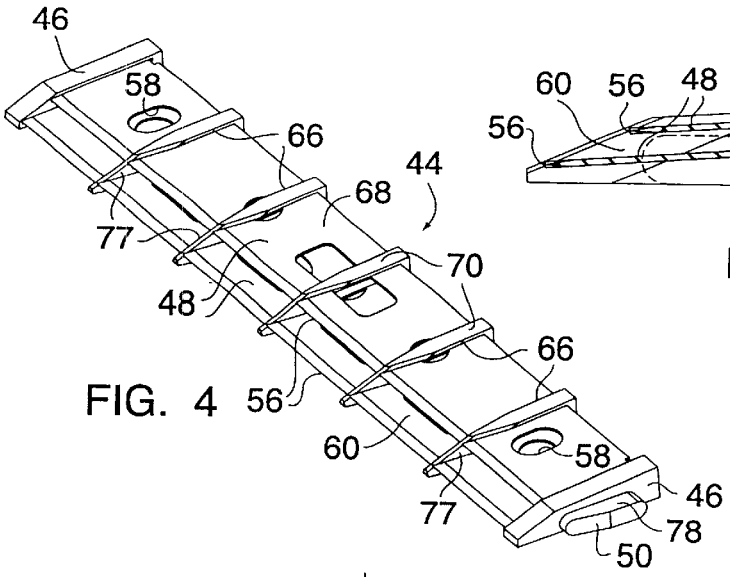
FIG. 4 is a perspective view of the cartridge adapted to be slidably received in the cavity of the shaving head of FIG. 1.
Figure 6:
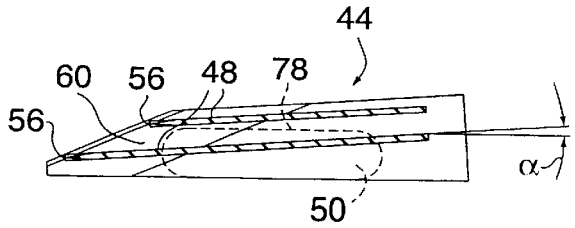
FIG. 6 is a schematic illustration of the cartridge of FIG. 5 showing the orientation of a pair of dynamic blades relative to one another.
Figure 5:
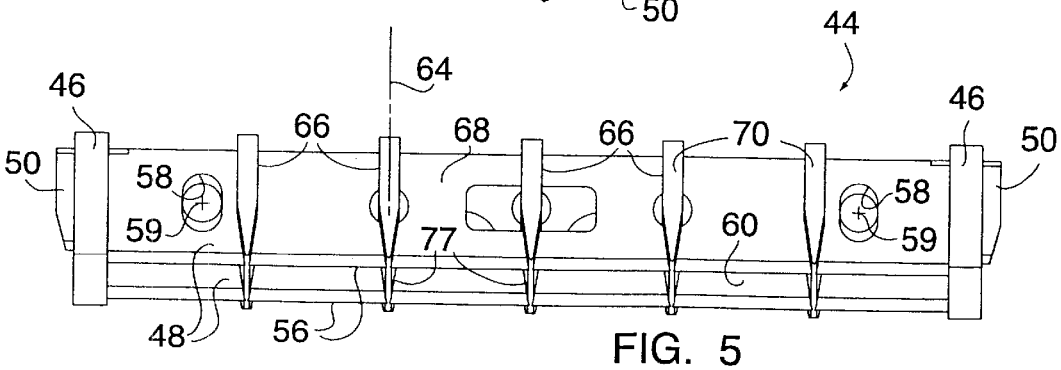
FIG. 5 is a plan view of the cartridge of FIG. 4.

As shown in FIGS. 4–6, a cartridge generally designated by the reference number 44, includes a pair of end rails 46 spaced apart relative to one another and having a pair of dynamic blades 48 mounted thereto and extending therebetween. The end rails 46 each define a protuberance 50 adapted to slidably engage slots 54, only one shown in FIG. 3, in the cavity 22. Each dynamic blade 48 has a cutting edge 56 adjacent to the cutting edge of the other dynamic blade. The cutting edges 56 are offset relative to one another, and the pair of dynamic blades 48 are spaced apart from one another defining a gap 60 therebetween. During the assembly of the cartridge 44, the dynamic blades 48 are aligned via apertures 58 having aligned central axis 59 extending through each of the dynamic blades.

As with the shaving head 10, the cartridge 44 includes a plurality of rails each having a longitudinal axis 64 approximately perpendicular to the cutting edges 56 of the dynamic blades 48. A fourth set of rails 66 extends from an outer surface 68 of one of the pair of dynamic blades 48. Each rail 66 is spaced apart from the next successive rail and defines an outwardly facing surface 70 adapted to slidably engage slots 72, FIG. 2, in the shaving head 10, when the cartridge 44 is located in the cavity 22. A fifth set of rails 77 is located in the gap 60 between the dynamic blades 48. Each of the rails in the fourth and fifth sets of rails, 66 and 77 respectively, defines a tip portion, preferably rounded, which extends past the cuffing edges 56 of the dynamic blades. While the fourth and fifth sets of rails 66 and 77 of the present invention have been shown in the illustrated embodiment as being aligned with one another and equally spaced apart, the present invention is not limited in this regard as the rails can be staggered and/or unequally spaced relative to one another without departing from the broader aspects of the present invention.

As shown in FIG. 6, the pair of dynamic blades 48 are positioned in the cartridge 44 at a downward angle designated by the symbol "$\alpha$" relative, in the illustrated embodiment, to an upper surface 78 of each protuberance 50 projecting outwardly from each end rail 46. Accordingly, when the cartridge 44 is positioned in the cavity 22, the dynamic blades 48 will be oriented at a lower shaving angle than the static blades 18. While a cartridge employing a pair of dynamic blades has been shown and described, the present invention is not limited in this regard as a single, or more than two dynamic blades may be employed. In addition, the angle $\alpha$ can be larger or smaller than is illustrated without departing from the broader aspects of the present invention.

Figure 7:
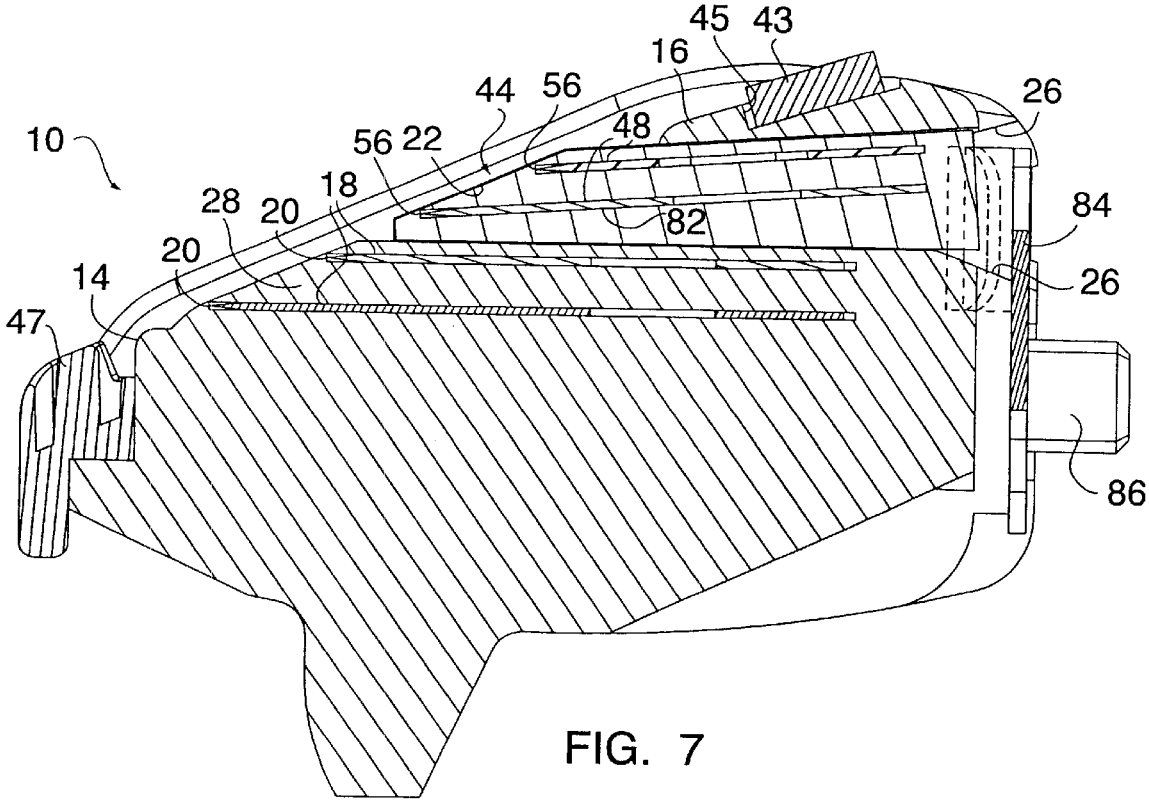
FIG. 7 is a cross-sectional view of a shaving implement embodying the present invention with the cartridge of the present invention positioned in the cavity, the cartridge being shown in the neutral position.

Turning to FIG. 7, the cartridge 44 is shown in the neutral position wherein no forces are exerted on the dynamic blades 48. The cartridge 44 is slidably positioned in the cavity 22. The tapered walls 26 allow for ease of insertion of the cartridge 44 into the cavity 22 during assembly of the shaving implement. The lower surface 82 of the dynamic blade 48 is approximately parallel to the slots 72 of the shaving head (see FIG. 2). The static blades 18 are carried by the support surfaces 38 of the second set of rails 36, FIG. 2. With the cartridge 44 in the neutral position, the cutting edges 56 of the dynamic blades 48 extend past the shaving plane.

Figure 8:
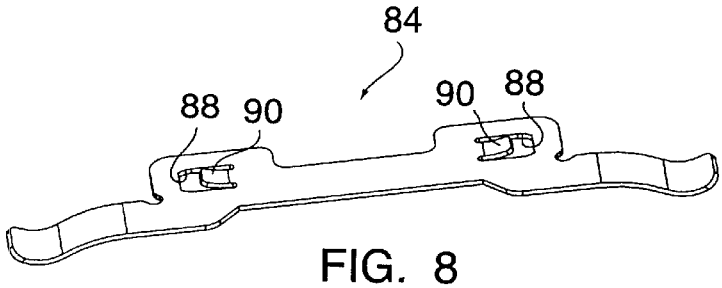
FIG. 8 is a perspective view of a resilient strip that forms part of the shaving implement of the present invention.
Figure 9:
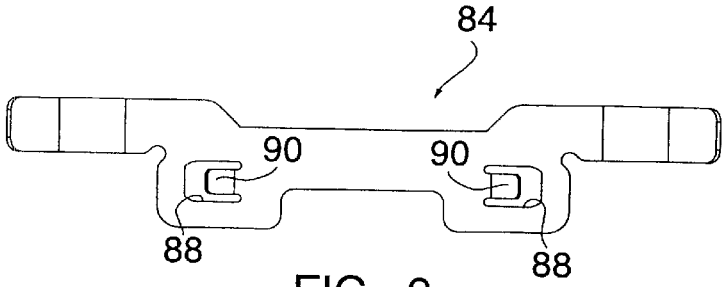
FIG. 9 is a plan view of the resilient strip of FIG. 8.

The cartridge 44 is held within the cavity 22 by a resilient strip 84 mounted to a pair of posts 86 projecting outwardly from the shaving head 10. The resilient strip 84 as shown in FIGS. 8 and 9 is preferably formed from spring steel and urges the cartridge 44 toward the neutral position. However, the present invention is not limited in this regard as the resilient strip 84 may be formed from other materials, such as polymers or rubbers that possess the requisite spring-like qualities. The resilient strip 84 defines a pair of spaced apart apertures 88 adapted to receive the posts 86. A tab 90 extends into each aperture 88 and frictionally engages the post 86 to secure the resilient strip 84 onto the shaving head 10.

Figure 10:
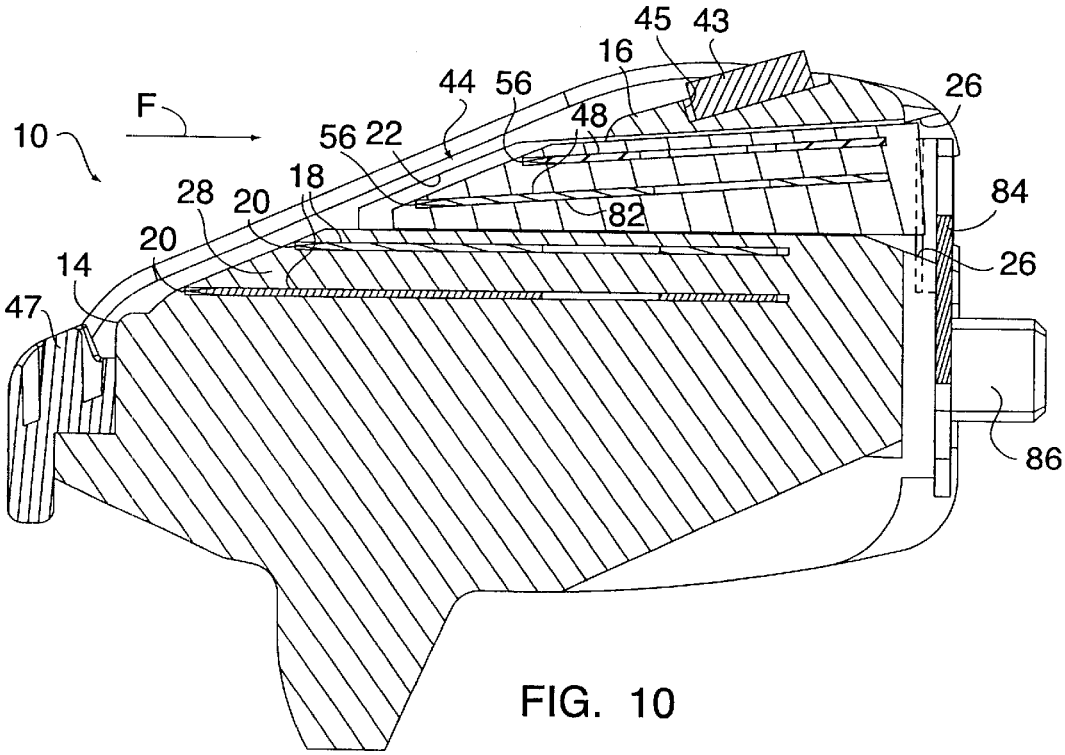
FIG. 10 is a cross-sectional view of the shaving implement of the present invention showing the cartridge in a position resulting from shaving forces exerted on the dynamic blade forming part of the cartridge.

Turning to FIG. 10, during a shaving operation, forces, illustrated in FIG. 10 by the arrow labeled "F", generated by pressing the shaving head 10 to the user's skin, cause the cartridge 44, and thereby the dynamic blades 48 to slide in the cavity 22 relative to the static blades 18. The resilient strip 84 acts to bias the cartridge 44 toward the neutral position, thereby allowing the dynamic blades 48 to closely follow the contours of the user's skin. Moreover, even though the dynamic blades 48 extend past the shaving plane the angle $\alpha$ assumed by the dynamic blades 48 relative to the static blades 18 allows for a more comfortable shaving experience based on the fact that the dynamic blades 48 extend past the static blades 18 when the cartridge 44 is in the neutral position.

As will be recognized by those skilled in the pertinent art, numerous changes and modifications may be made to the above described and other embodiments of the present invention without departing from its scope as defined in the appended claims.

What is claimed is:

1. A shaving implement having static and dynamic blades comprising:

a shaving head including an approximately rigid guard and a cap spaced away from and approximately parallel to said guard, said guard and said cap each extending longitudinally of said shaving head;

at least one static blade secured to said shaving head and defining a cuffing edge located between and approximately parallel to said guard and said cap;

said shaving head defining a cavity adjacent to said static blade;

a cartridge adapted to be slidably received in said cavity, said cartridge having at least one dynamic blade mounted therein;

said dynamic blade defining a cutting edge extending longitudinally of said shaving head and approximately parallel to said cuffing edge of said static blade when said cartridge is positioned in said cavity; and biasing means for urging said cartridge toward a neutral position wherein said cuffing edge of said dynamic blade extends past a plane extending in a direction longitudinal of said shaving head and approximately tangent to said guard and said cap, said cartridge and thereby said dynamic blade being movable relative to said shaving head due to forces exerted thereagainst during a shaving operation.

2. A shaving implement as defined by claim 1 wherein:

said biasing means is a resilient strip coupled to said shaving head and in biasing communication with said cartridge.

3. A shaving implement as defined by claim 1 wherein said shaving head defines an opening approximately opposite said cuffing edge of said static blade and extending into said cavity, said opening being adapted to allow said cartridge to pass therethrough.

4. A shaving implement as defined by claim 3 wherein:

said cartridge includes a pair of end walls one coupled to each end of said dynamic blade;

said cavity being defined in part by a pair of opposing side walls each having a slot extending therealong, said slot being substantially perpendicular to said cuffing edge of said static blade and approximately parallel to a lower surface of the dynamic blade; and wherein said end walls each define a protuberance extending outwardly therefrom and adapted to slidably engage one of said slots.

5. A shaving implement as defined by claim 3 wherein said biasing means is a resilient strip extending across said opening and coupled to said shaving head, said resilient strip being in communication with said cartridge for urging said cartridge toward said neutral position in response to a force exerted against said dynamic blade.

6. A shaving implement as defined by claim 5 wherein:

said shaving head defines a pair of posts projecting outwardly therefrom approximately opposite said cuffing edge of said static blade;

said resilient strip defines a pair of apertures each adapted to mate with one of said posts, a tab extending into each aperture for functionally engaging said posts and securing said resilient strip to said shaving head.

7. A shaving implement as defined by claim 1 wherein:

said static blade has a first surface facing said approximately rigid guard and a second surface facing said cap;

said shaving head includes a plurality of rails each in engagement with one of said first and second surfaces, said rails on each of said first and second surfaces being spaced apart relative to one another and approximately perpendicular to said cuffing edge of said static blade; and wherein at least a portion of said rails each define a support surface that extends into said cavity and slidably engages said cartridge.

8. A shaving implement as defined by claim 1 wherein:

said at least one static blade includes a pair of static blades each defining a cuffing edge, said static blades being approximately parallel and adjacent to one another and defining a gap therebetween;

one of said pair of static blades having a surface approximately perpendicular to said cutting edge of said static blade, and at least partially extending into said cavity;

a plurality of first rails positioned in said gap and engaging each of said pair of static blades, said first rails being approximately perpendicular to said cutting edges of said static blades and spaced apart relative to one another; and a plurality of second rails approximately perpendicular to said cuffing edges of said static blades, said second rails defining a support surface adapted to slidably engage said cartridge when said cartridge is positioned in said cavity.

9. A shaving implement defined by claim 8 wherein each of said plurality of first and second rails define a tip portion that extends past said cuffing edges of said static blades.

10. A shaving implement as defined by claim wherein said at lease one dynamic blade includes two dynamic blades defining a gap therebetween, each of said dynamic blades having a cuffing edge, said cuffing edges being adjacent to one another.

11. A shaving implement as defined by claim 10 further comprising a plurality of rails positioned within said gap and in engagement with each of said dynamic blades, said rails being spaced apart relative to one another.

12. A shaving implement as defined by claim 11 wherein each of said rails is approximately perpendicular to said cuffing edges defined by said dynamic blades.

13. A shaving implement as defined by claim 12 wherein each of said rails defines a tip portion extending past the cutting edges of said dynamic blades.

14. A shaving implement as defined by claim 10 wherein said dynamic blades are inclined relative to one another.

15. A shaving implement as defined by claim 1 wherein said at least one static blade includes two static blades, each having a cuffing edge adjacent to the cutting edge of the other.

16. A shaving implement as defined by claim 1 further comprising a resilient guard having a portion extending beyond a plane defined by a tangent to said approximately rigid guard and said cap and said resilient guard extending longitudinally of said static blade.

17. A shaving implement as defined by claim 1 wherein said dynamic blade is positioned at a different shaving angle than said static blade.

* * * * *

UNITED STATES PATENT AND TRADEMARK OFFICE

CERTIFICATE OF CORRECTION

PATENT NO. : 6,769,180 B2
DATED : August 3, 2004
INVENTOR(S) : David C. Coffin

It is certified that error appears in the above-identified patent and that said Letters Patent is hereby corrected as shown below:

Column 3,
Lines 33, 56 and 63, “cuffing” should read -- cutting --.

Column 4,
Line 46, “cuffing” should read -- cutting --.

Column 5,
Lines 54, 63 and 66, “cuffing” should read -- cutting --.

Column 6,
Lines 12, 20, 35-36, 49 and 56, “cuffing” should read -- cutting --.

Column 7,
Lines 2, 8, 12 and 20, “cuffing” should read -- cutting --.

Column 8,
Line 8, “cuffing” should read -- cutting --.

Signed and Sealed this

Twelfth Day of October, 2004

JON W. DUDAS
*Director of the United States Patent and Trademark Office*